US005539948A

United States Patent [19]

McCauley et al.

[11] Patent Number: 5,539,948

[45] Date of Patent: Jul. 30, 1996

[54] PAINT ROLLER CLEANING ADAPTER

[76] Inventors: Pat McCauley, 1369 Bonair Rd., Vista, Calif. 92083; Ronald Smith, 812 Citrus Pl., Carlsbad, Calif. 92008

[21] Appl. No.: 419,287

[22] Filed: Apr. 10, 1995

[51] Int. Cl.[6] ..... B08B 3/04

[52] U.S. Cl. ..... 15/105; 15/38; 15/236.03; 134/900

[58] Field of Search ..... 15/38, 105, 236.03; 134/900, 149; 34/58

[56] References Cited

U.S. PATENT DOCUMENTS

| | | | |
|---|---|---|---|
| 2,344,017 | 3/1944 | Ashpes . | |
| 2,542,491 | 2/1951 | Engel . | |
| 2,711,748 | 6/1955 | Barshess . | |
| 2,794,264 | 6/1957 | Scholtka . | |
| 2,794,265 | 6/1957 | Kruger . | |
| 2,826,826 | 2/1958 | Boehm . | |
| 2,860,858 | 11/1958 | Kurs | 15/236.03 X |
| 2,881,533 | 4/1959 | Johnson . | |
| 2,884,709 | 5/1959 | Kruger . | |
| 2,912,769 | 11/1959 | Kruger . | |
| 3,085,583 | 4/1963 | Siek . | |
| 3,436,264 | 4/1969 | Allen . | |
| 3,696,457 | 10/1972 | Hand | 15/4 |
| 3,733,645 | 5/1973 | Seiler | 15/257 |
| 3,837,091 | 9/1974 | Meyer | 34/58 |
| 3,925,908 | 12/1975 | Dunn | 34/58 |
| 4,263,055 | 4/1981 | Permar | 134/33 |
| 4,324,018 | 4/1982 | Olsson | 15/236.03 |
| 4,545,395 | 10/1985 | Kolb | 134/115 R |

FOREIGN PATENT DOCUMENTS

| | | | |
|---|---|---|---|
| 749275 | 5/1956 | United Kingdom | 15/236.03 |
| 2220464 | 3/1994 | United Kingdom | 15/236.03 |

*Primary Examiner*—Philip R. Coe
*Attorney, Agent, or Firm*—Tom Hamill, Jr.

[57] ABSTRACT

An adapter for a rotating device such as a manually operated spinner or electric drill is disclosed for the cleaning and drying of paint rollers. In painting, small rollers known as "weenie rollers" or "slim jims" are employed to permit paint to be applied to hard to reach areas such as on top of doors or behind radiators. Currently these small rollers are single use and intended to be disposed. The adapter of the invention will permit these small rollers to be cleaned and reused. The adapter will be intermediate the small roller and the device imparting rotating motion. The small roller includes a centrally disposed aperture which receives a mating portion of the adapter. A roller scraping element is disposed on the body of the adapter. The adapter includes a portion for coacting with various devices which impart rotary motion. The adapter may be constructed of plastic or other suitable material. The adapter may be mass produced by plastic injection molding techniques.

14 Claims, 2 Drawing Sheets

PAINT ROLLER CLEANING ADAPTER

BACKGROUND OF THE INVENTION

1. Field of the Invention

The present invention relates generally to adapter elements for rotating devices, and more particularly, to an adapter especially adapted to effect the cleaning of small paint rollers to permit them to be reused.

Small paint rollers, commonly known as "slim jims" or "weenie rollers" are employed in the painting industry to apply paint to hard to reach areas. The diameter of the small paint roller is generally less than 1 inch. These small paint rollers, hereafter referred to as rollers, have a generally spongy surface which is fluffy, soft and pliable. A central bore is provided through the center of the roller which engages the paint applying handle. The central bore is generally less than ⅜ths of an inch in diameter. After the paint is applied to an area, the roller is covered and saturated with paint. Current practice is to dispose of the roller. This practice increases the general cost of materials as the roller elements are expensive, especially in professional operations where rollers of this type are employed regularly.

The adapter element of the instant invention is designed to be employed with a conventional hand held paint spinner or a electric rotary device such as an electric drill. The adapter mates with the roller as well as the rotation means. A scraping surface is provided on the adapter to permit extraneous paint and debris to be removed from the roller prior to spinning. After the scraping, the roller is placed in a suitable solvent, depending on the nature of the paint. Paint thinners, hot water and soap, or other fluids may be employed as a solvent. The rotation means imparts rotation through the adapter causing the roller to rapidly spin in the cleaning solvent. After the paint is removed, the solvent may be spun off as well. The roller is restored to its original spongy, fluffy, soft and pliable state which permits its reuse at another time. This adapter may be manufactured and sold at prices which will permit the savings of resources and money over the current practice.

2. Description of the Prior Art

Devices which impart a rotation to a paint roller in order to facilitate the cleaning of the paint roller have been disclosed in art. U.S. Pat. No. 2,542,491 discloses a device designed to clean paint rollers as well as to be rotated by an electric drill. This device is designed to clean the jackets of large paint rollers, and the adapter provided is substantially different than the instant invention. U.S. Pat. No. 2,542,491 cannot be employed to clean small rollers, even if the design was miniaturized.

U.S. Pat. No. 2,711,748 discloses another device for rotatably cleaning large rollers. An adapter element is provided which mates to an electric drill. A generally cylindrical core element depends from the drill engagement means with a pair of slots located thereon. A roller sleeve is designed to be placed over the core element with the slots permitting the sleeve to fit in snug fashion. Once again, this device is designed to clean the sleeves of large paint rollers, and the adapter provided cannot be employed to clean small rollers, even if the design were miniaturized.

U.S. Pat. No. 4,263,055 discloses yet another large roller paint cleaning adapter element. The adapter is once again designed to be employed with an electric drill and had a coil depending from the drill mating element. The coil is helical and comprises a wire element which would mate with the large paint roller sleeve. Once again, this device is designed to clean the sleeves of large paint rollers, and the adapter provided cannot be employed to clean small rollers, even if the design were miniaturized.

Thus, while the foregoing body of prior art indicates it to be well known to use devices which mate with electric rotation devices to effect the cleaning of paint roller sleeves, the provision of an adapter to employed for the cleaning of small paint rollers is not contemplated. The instant invention is a simple and cost effective device and is not shown or taught in the prior art. Nor does the prior art described above teach or suggest an adapter device which may be employed in its rotational cleaning capacity with an additional roller scraping surface which may be used by painters to more thoroughly clean the rollers. No known prior art device even if miniaturized, that is, even if reduced in scale would teach or show the instant invention. The foregoing disadvantages are overcome by the unique embodiments of the present invention as will be made apparent from the following description thereof. Other advantages of the present invention over the prior art also will be rendered evident.

SUMMARY OF THE INVENTION

To achieve the foregoing and other advantages, the present invention, briefly described, provides an adapter for a rotating device such as a manually operated spinner or electric drill is disclosed for the cleaning and drying of paint rollers. The adapter of the invention will permit these small rollers to be cleaned and reused. The adapter will be intermediate the small roller and the device imparting rotating motion. The small roller includes a centrally disposed aperture which receives a mating portion of the adapter. A paint roller scraping element is disposed on the body of the adapter. The roller scraping element is provided on the body of the adapter and may be a semicircular cutout. The semicircular cutout may include teeth in order to facilitate the scraping or removal of the paint from the roller. The adapter includes a portion for coacting with various devices which impart rotary motion. Several embodiments of the invention exist, and includes adapter which will be secured in the chuck of an electric rotating device, such as a drill, as well as an adapter which may be secured in a manual paint spinner device, such as those described in U.S. Pat. Nos. 2,794,265, 2,884,709, and 2,912,769, which are incorporated by reference forthwith. One embodiment includes radial wing portions located on the adapter body which include a semi-circular aperture approximately the diameter of the small roller. This aperture is designed specifically to coact with the paint saturated small roller, prior to attachment to the adapter. It will scrape off excess paint and debris which may have accumulated due to the intrinsic adhesive capacity of wet/drying paint. The adapter may be constructed of plastic or other suitable material. The adapter may be mass produced by plastic injection molding techniques.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining several preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint roller adapter which would permit the efficient and effective rotary cleaning of small paint rollers.

Still a further object of the present invention is to provide a new and improved paint roller adapter including means for scraping the small paint roller.

It is another object of the present invention to provide a new an improved paint roller adapter which may be easily and efficiently manufactured and marketed, It is a further objective of the present invention to provide a new and improved paint roller adapter which is of durable and reliable construction.

An even further object of the present invention is to provide a new and improved paint roller adapter which is susceptible of a low cost of manufacture with regard to both materials and labor, and which accordingly is then susceptible of low prices of sale to the consuming public, thereby making such a paint roller adapter available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved paint roller adapter embodying the principles and concepts of the present invention will be described.

Figure 1:
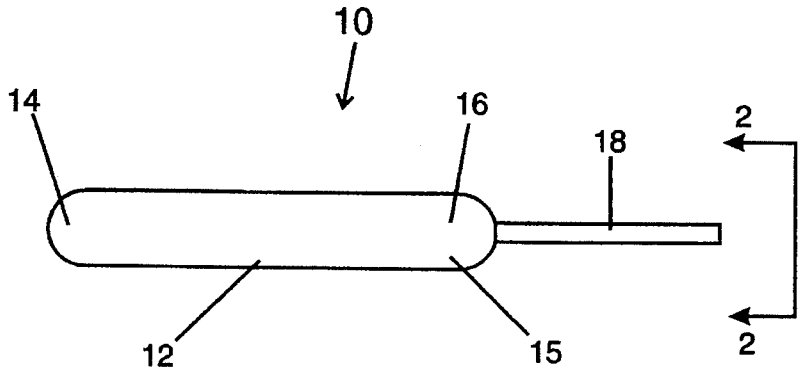
FIG. 1 is a perspective view showing the first preferred embodiment of the paint roller adapter of the invention.
Figure 6:
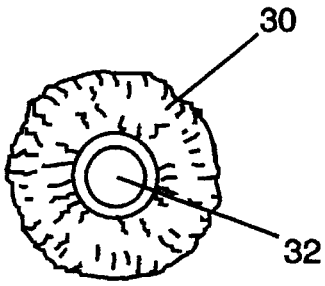
FIG. 6 is a view of the small paint roller taken across the line 6—6 of FIG. 5.

Turning initially to FIG. 1, there is shown a first exemplary embodiment of the paint roller adapter of the invention generally designated by reference numeral 10. In its preferred form, the paint roller adapter 10 comprises generally elongated body portion 12 with a first side 14 and a second side 16. A rod portion 18 depends from the second side 16. The second side 16 tapers into rod portion 18 in a fashion such as depicted on or about element 15. The rod portion 18 is generally circular and is designed to mate in a male fashion with the small roller 30. Small roller 30 has a centrally disposed aperture 32 which is best seen in FIG. 6. The rod portion 18 would be received in this aperture 32. Element 15 would cause a locking or a tight nesting of small paint roller 30 on the paint roller adapter 10. This would in no way be permanent and is easily disengageable. The first side 14 is designed to be received in the locking spring jaws of a manual paint spinner device (not shown), such as the device shown in U.S. Pat. No. 2,912,769. First side 14 is shown to be rounded but does not necessarily have to be this shape. The manual paint spinner device would then be actuated causing a rotational motion of the small paint roller 30.

Figure 2:
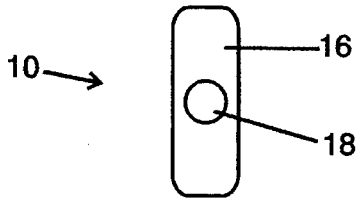
FIG. 2 is a view of the paint roller adapter along the line 2—2 of FIG. 1.

Turning now to FIG. 2, the first embodiment of the invention is shown in cross section. The paint roller adapter 10 has a generally rectangular cross section as shown. Second side 16 is shown having rod portion 18 extend outwardly therefrom. Rod portion 18 would be received in aperture 32 of the small paint roller 30.

Figure 3:
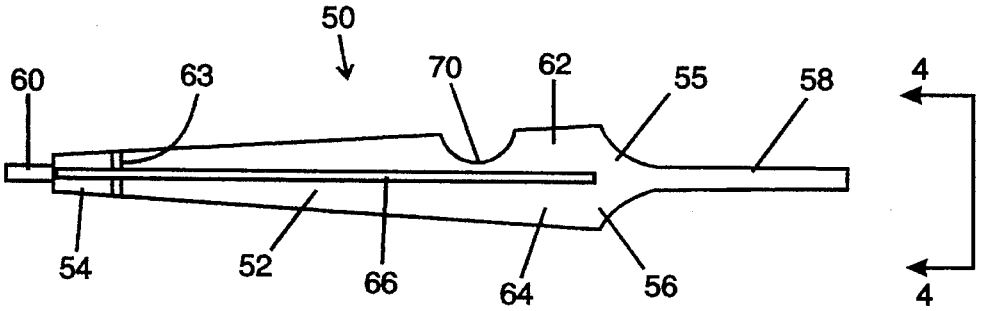
FIG. 3 is a view showing the second preferred embodiment of the paint roller adapter of the invention.

Referring now specifically to FIG. 3 a second embodiment of the paint roller adapter is shown and designated generally by reference numeral 50. The paint roller adapter 50 comprises generally elongated body portion 52 with a first side 54 and a second side 56. A rod portion 58 depends from the second side 56. The second side 56 tapers into rod portion 58 in a fashion such as depicted on or about element 55. The rod portion 58 is generally circular and is designed to mate in a male fashion with the small roller 30. Small roller 30 has a centrally disposed aperture 32 which is best seen in FIG. 6. The rod portion 58 would be received in this aperture 32. Element 55 would cause a locking or a tight nesting of small paint roller 30 on the paint roller adapter 10. This would in no way be permanent and is easily disengageable. The first side 54 is designed to be received in the locking spring jaws of a manual paint spinner device (not shown), such as the device shown in U.S. Pat. No. 2,912,769 as well as a chuck of an electric rotary device, such as an electric drill or screwdriver. First side 54 is shown with a chuck mating element 60 protruding therefrom. This embodiment of the adapter 50 may also may be utilized with an electric rotary device which has a chuck member. Chuck mating element 60 would be received in the chuck of such a device.

Figure 4:
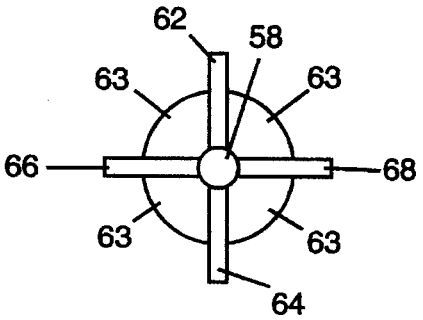
FIG. 4 is a view of the paint roller adapter taken across the line 4—4 of FIG. 3.
Figure 5:
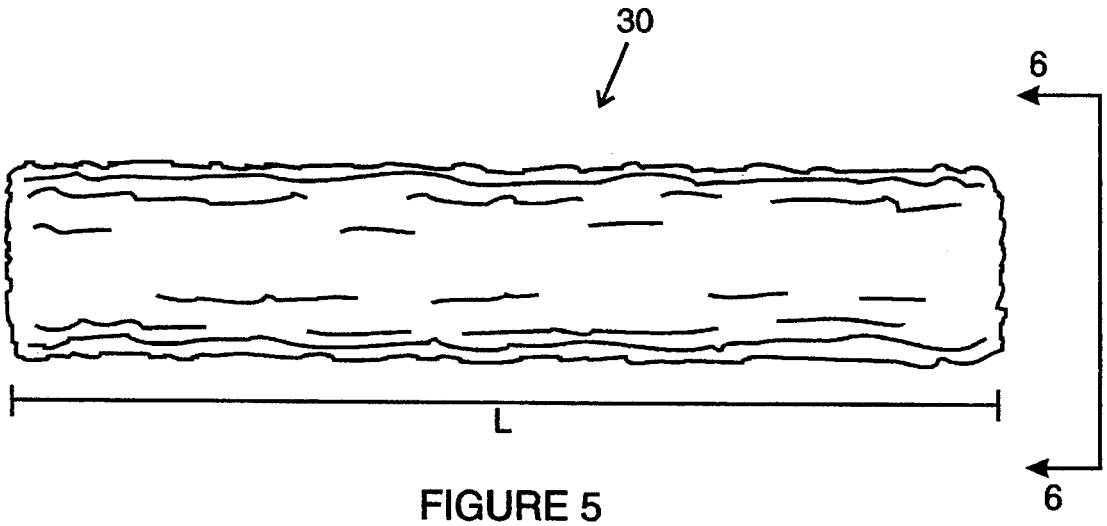
FIG. 5 is a view showing a small paint roller which would be mated to the adapter of the instant invention.

Four wing elements, 62, 64, 66, and 68 are provided on elongated body portion 52. These wing elements are relatively thin and are best shown in FIG. 4. One of the wing elements, in this embodiment wing element 62, has a generally circular cutout 70 located thereon. Cutout 70 is designed to receive small paint roller 30 and to permit the paint roller adapter 50 to be utilized as a scraping device, debriding paint and debris from the small paint roller 30 as part of the cleaning process. The semicircular cutout 70 may include teeth in order to facilitate the scraping or removal of the paint from the roller. Cutout 70 would simply engage the small paint roller 30 and be passed over the length (L) of the paint roller 30 (best shown in FIG. 5) in a scraping type or reciprocating motion. The adapter 50 would then be secured in the manual or electrical rotary imparting device and the paint roller 30 placed over rod 58. The small paint roller 30 would then be immersed in a paint solvent. The rotating action in the solvent will permit the small paint roller 30 to be returned to its initial paint free state, which would permits its reuse. Rib elements 63 are provided to provide stability to the wing elements, and may not be required in certain manufactures. More than one cutout 70 may be provided. Other wing configurations are possible.

FIG. 6 simply shows the centrally disposed aperture 32 of small paint roller 30. The centrally disposed aperture 32 essentially traverses the length of the small roller 32.

It is apparent from the above that the present invention accomplishes all of the objectives set forth by providing a new and improved paint roller adapter which would permit the efficient and effective rotary cleaning of small paint rollers, as well as means for scraping the small paint roller. This would permit the small paint roller 30 to be reused thus reducing painting costs.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. An adapter to permit the cleaning paint rollers which have a centrally disposed aperture, which is designed to be employed with a device which imparts rotary motion comprising:

an elongated portion having a generally rectangular cross section, said elongated portion having a first side and a second side, said first side including a mating means, said second side having a rod element depending therefrom, said elongated portion having a body disposed intermediate said first side and said second side defining a one-piece unitary construction, said second side having a first width, said rod element having a second width, said first width being greater than said second width, whereby said first side would be received in the device and said rod element would be received in the aperture of the paint roller, permitting the paint roller to be rotated by the device in a paint cleaning solvent to facilitate cleaning.

2. An adapter as claimed in claim 1 wherein said mating means is generally rounded.

3. An adapter as claimed in claim 2 including a tapered element, said tapered element intermediate said second side and said rod element.

4. An adapter as claimed in claim 3 wherein said adapter is manufactured from plastic.

5. An adapter as claimed in claim 1 wherein said elongated portion is generally rectangular and includes a semicircular cutout, said semicircular cutout to be employed in the scraping of excess paint from the paint roller.

6. An adapter to permit a paint roller with a centrally disposed aperture to be rotated by a device which imparts rotary motion comprising:

an elongated portion having a generally rectangular cross section, said elongated portion having a first side and a second side, said second side having a first rod element depending therefrom, said elongated portion having a body disposed intermediate said first side and said second side defining a one-piece unitary construction, said first side including mating means, said elongated portion including a wing, said wing having a semicircular cutout thereon, said semicircular cutout to be employed in the scraping of excess paint from the paint roller, whereby said mating means would be received in the device and said rod element would be received in the centrally disposed aperture of the paint roller, permitting the paint roller to be rotated.

7. An adapter as claimed in claim 6 wherein said second width is less than ½ inch.

8. The adapter as claimed in claim 6 wherein said semicircular cutout includes teeth.

9. An adapter as claimed in claim 6 wherein said mating means includes a chuck mating means.

10. An adapter as claimed in claim 9 including a tapered element, said tapered element intermediate said second side and said rod element.

11. An adapter as claimed in claim 10 wherein said adapter is manufactured from plastic.

12. An adapter as claimed in claim 11 wherein said second side includes a first width, said first rod element having a second width and said first width is greater than said second width.

13. An adapter as claimed in claim 12 wherein said second width is less than ½ inch.

14. An adapter as claimed in claim 13 wherein said second width is such to permit said first rod element to be received in the centrally disposed aperture of the paint roller.

* * * * *